US009584929B2

(12) United States Patent
Moerkebjerg et al.

(10) Patent No.: US 9,584,929 B2
(45) Date of Patent: Feb. 28, 2017

(54) METHOD AND PROCESSING UNIT FOR ADAPTIVE WIND NOISE SUPPRESSION IN A HEARING AID SYSTEM AND A HEARING AID SYSTEM

(75) Inventors: Martin Moerkebjerg, Copenhagen (DK); Chunjian Li, Vallensbaek Strand (DK)

(73) Assignee: Widex A/S, Lynge (DK)

( * ) Notice: Subject to any disclaimer, the term of this patent is extended or adjusted under 35 U.S.C. 154(b) by 974 days.

(21) Appl. No.: 13/349,294

(22) Filed: Jan. 12, 2012

(65) Prior Publication Data

US 2012/0128163 A1 May 24, 2012

Related U.S. Application Data

(63) Continuation-in-part of application No. PCT/DK2009/000178, filed on Jul. 15, 2009.

(51) Int. Cl.
*H04R 5/00* (2006.01)
*H04R 25/00* (2006.01)

(52) U.S. Cl.
CPC ..... *H04R 25/407* (2013.01); *H04R 25/552* (2013.01); *H04R 2410/07* (2013.01); *H04R 2430/03* (2013.01)

(58) Field of Classification Search
CPC H04R 25/407; H04R 25/552; H04R 2410/07; H04R 2430/03

(Continued)

(56) References Cited

U.S. PATENT DOCUMENTS 5,471,538 A * 11/1995 Sasaki ..... H04R 3/005 381/91
6,882,736 B2 4/2005 Dickel et al.
(Continued)

FOREIGN PATENT DOCUMENTS

WO WO 0195666 A2 12/2001
WO WO 0230150 A2 4/2002
WO WO 2007042025 A1 4/2007

OTHER PUBLICATIONS

International Search Report for PCT/DK2009/000178 dated Feb. 10, 2010.

(Continued)

*Primary Examiner* — Vivian Chin
*Assistant Examiner* — William A Jerez Lora
(74) *Attorney, Agent, or Firm* — Sughrue Mion, PLLC

(57) ABSTRACT

A processing unit that adaptively suppresses wind noise in a hearing aid is provided. The processing unit (100) comprises a first microphone (105) and a second microphone (106). The analog signal from the first microphone is converted to a first digital signal (107) in a first A/D converter (113) and the analog signal from the second microphone is converted to a second digital signal (108) in a second A/D converter (114). The output of the first A/D converter is operationally connected to a first input of a subtraction node (111). The output of the second A/D converter is operationally connected to the input of an adaptive filter (109). The output of the adaptive filter (109) is branched and in a first branch operationally connected to the second input of the subtraction node (111) and in a second branch operationally connected to the input of the remaining signal processing in the hearing aid. The output from the subtraction node (111) is operationally connected to a control input of the adaptive filter (109). The invention also relates to a hearing aid (Continued)

system having such a processing unit and a method of adaptive wind noise suppression in a hearing aid system.

25 Claims, 6 Drawing Sheets

(58) Field of Classification Search
USPC ..... 381/317, 312, 313, 318, 94.5, 23.1
See application file for complete search history.

(56) References Cited

U.S. PATENT DOCUMENTS

| | | | | |
|---|---|---|---|---|
| 7,127,076 | B2 | 10/2006 | Roeck et al. | |
| 2002/0037088 | A1* | 3/2002 | Dickel | H04R 25/407 381/317 |
| 2002/0164042 | A1* | 11/2002 | Vonlanthen | 381/313 |
| 2004/0086137 | A1* | 5/2004 | Yu | G10L 21/0208 381/71.11 |
| 2005/0041825 | A1* | 2/2005 | Rasmussen | H04R 25/402 381/317 |
| 2008/0273728 | A1* | 11/2008 | Tjalfe Klinkby | H04R 25/453 381/318 |
| 2008/0317261 | A1* | 12/2008 | Yoshida | H04R 3/04 381/94.1 |
| 2009/0268933 | A1* | 10/2009 | Baechler | H04R 25/554 381/318 |

OTHER PUBLICATIONS

King Chung et al, "Wind noise in hearing aids with directional and omnidirectional microphones: Polar characteristics of behind-the-ear hearing aids", The Journal of the Acoustical Society of America, American Institute of Physics for the Acoustical Society of America, New York, NY, US, vol. 175, No. 4, Apr. 1, 2009, pp. 2243-2259 XP012123193.

* cited by examiner

METHOD AND PROCESSING UNIT FOR ADAPTIVE WIND NOISE SUPPRESSION IN A HEARING AID SYSTEM AND A HEARING AID SYSTEM

RELATED APPLICATIONS

The present application is a continuation-in-part of application PCT/EP2009000178, filed on Jul. 15, 2009, in Denmark and published as WO2011006496 A1.

BACKGROUND OF THE INVENTION

1. Field of the Invention

The present invention relates to hearing aids. The invention, in particular, relates to methods for wind noise suppression in hearing aid systems. The invention, more specifically, relates to methods and processing units for adaptive wind noise suppression in hearing aid systems. The invention further relates to hearing aid systems having means for adaptive wind noise suppression.

In the context of the present disclosure, a hearing aid system should be understood as a system for alleviating the hearing loss of a hearing-impaired user. A hearing aid system may be monaural and comprise only one hearing aid or be binaural and comprise two hearing aids.

In the context of the present disclosure, a hearing aid should be understood as a small, microelectronic device designed to be worn behind or in a human ear of a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a microelectronic circuit comprising a signal processor, and an acoustic output transducer. The signal processor is preferably a digital signal processor. The hearing aid is enclosed in a casing suitable for fitting behind or in a human ear.

In the present context wind noise is defined as the result of pressure fluctuations at the hearing aid microphones due to turbulent airflow. As opposed hereto, acoustic sounds created by winds are not considered as wind noise here, because such sounds are part of the natural environment.

2. The Prior Art

U.S. Pat. No. 7,127,076 B2 discloses a method for manufacturing an acoustical device, especially a hearing device. A device casing is provided with an acoustical/electrical input converter arrangement with an electric output. An audio signal processing unit establishes audio signal processing of the device according to individual needs and/or purpose of the device. At least one electrical/mechanical output converter is provided. A filter arrangement with adjustable high-pass characteristic has a control input for the characteristic. The following operational connections are established: between the output of the input converter arrangement and the input of the filter arrangement, between the output of the filter arrangement and the control input, between said output of the filter arrangement and the input of the processing unit and between the output of the processing unit and the input of the at least one output converter.

U.S. Pat. No. 7,127,076 B2 also discloses a method for wind noise suppression based on output signals from two microphones. In a first step the output signals are transformed into the frequency domain and applied to a spatial filter, such as a beam former. In a second step a Wiener filter is applied to the signal output from the spatial filter. In the final step the resulting spectrum is transformed back to the time domain to produce a wind noise suppressed signal.

One problem with a system based on a configuration with a Wiener filter is, that it requires an estimate of the noise spectrum. The noise spectrum is difficult to estimate and the reliability and efficiency of the system may therefore suffer, especially when the wind noise spectrum is time varying.

U.S. Pat. No. 6,882,736 B2 discloses a method for detection and subsequent suppression of wind noise based on input from several microphones. One of the measures for reducing detected wind noises is the application of a subtraction filter. Such a subtraction filter seeks to ensure that only those signal components that emanate equally from all the microphones, are further processed and fed to the earphone. Uncorrelated wind noise, which emanates from only one microphone, is suppressed.

One problem with this system is that the wind noise is not efficiently suppressed by a simple subtraction of the microphone output signals.

SUMMARY OF THE INVENTION

It is therefore a feature of the present invention to overcome at least these drawbacks and provide more efficient and reliable methods and processing units for adaptive suppression of wind noise in hearing aid systems while maintaining the sound fidelity of the acoustical sounds. Hereby user comfort and intelligibility for the hearing impaired can be improved.

It is another feature of the present invention to provide a hearing aid system comprising a processing unit adapted for adaptive wind noise suppression.

The invention, in a first aspect, provides a processing unit for adaptive suppression of wind noise in a hearing aid system comprising a first and a second microphone for conversion of an acoustic signal into a first and a second electric signal, respectively, a first and a second A/D converter for conversion of the first and the second electric signal into a first and a second digital signal, respectively, a first subtraction node, and a first adaptive filter, the first subtraction node having a first input, which is operationally connected to the output of the first A/D converter, a second input which is operationally connected to the output of the first adaptive filter, and an output denoted the fourth digital signal which is fed to a control input to the first adaptive filter, the first adaptive filter having an input, which is operationally connected to an output of the second A/D converter, an output denoted the third digital signal, which is fed to an input of a digital signal processor and to the second input of the first subtraction node, and a control input for controlling the adaptation of the first adaptive filter, the value of the fourth digital signal being calculated as the value of the third digital signal subtracted from the value of the first digital signal.

This provides a processing unit for adaptive suppression of wind noise that is both efficient and provides a high sound fidelity.

The invention, in a second aspect, provides a hearing aid comprising a processing unit for adaptive wind noise suppression in a hearing aid system comprising a first and a second microphone for conversion of an acoustic signal into a first and a second electric signal, respectively, a first and a second A/D converter for conversion of the first and the second electric signal into a first and a second digital signal, respectively, a first subtraction node, and a first adaptive filter, the first subtraction node having a first input, which is operationally connected to the output of the first A/D converter, a second input which is operationally connected to the output of the first adaptive filter, and an output denoted the fourth digital signal which is fed to a control input to the first adaptive filter, the first adaptive filter having an input, which is operationally connected to an output of the second A/D converter, an output denoted the third digital signal, which is fed to an input of a digital signal processor and to the second input of the first subtraction node, and a control input for controlling the adaptation of the first adaptive filter, the value of the fourth digital signal being calculated as the value of the third digital signal subtracted from the value of the first digital signal.

The invention, in a third aspect, provides a binaural hearing aid system having a first and a second hearing aid wherein said first hearing aid comprises a first microphone, a first A/D converter, a first adaptive filter, a first subtraction node, a first digital signal processor, a first switch, a first antenna and first transceiver means, said second hearing aid comprises a second microphone, a second A/D converter, a second adaptive filter, a second subtraction node, a second digital signal processor, a second switch, a second antenna and second transceiver means, the first and second transceiver means and the first and second antenna are adapted for providing a bi-directional link between the first and the second hearing aid, the first subtraction node has a first input, which is connected to the output of the second A/D converter, a second input, which is connected to the output of the first adaptive filter and an output, which is connected to a control input to the first adaptive filter, the first adaptive filter has an input, which is connected to the output of the first A/D converter, an output, which is connected to an input of the first digital signal processor and to a second input of the first subtraction node, and a control input for controlling the adaptation of the first adaptive filter the second subtraction node has a first input, which is connected to the output of the first A/D converter, a second input, which is connected to the output of the second adaptive filter and an output, which is connected to a control input to the second adaptive filter, and the second adaptive filter has an input, which is connected to the output of the second A/D converter, an output, which is connected to an input of the second digital signal processor and to a second input of the second subtraction node, and a control input for controlling the adaptation of the second adaptive filter.

This provides hearing aid systems that efficiently suppress wind noise while maintaining a high sound fidelity.

The invention, in a fourth aspect, provides a method of adaptive wind noise suppression in a hearing aid comprising the following steps; providing a first signal representing the output from a first microphone, providing a second signal representing the output from a second microphone, filtering the first signal in an adaptive filter, thereby providing a third signal, subtracting the value of the third signal from the value of the second signal in a subtraction node, thereby providing a fourth signal, feeding the value of the fourth signal to a control input of the adaptive filter, and providing the third signal for further processing in the hearing aid.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawings.

DETAILED DESCRIPTION OF THE INVENTION

The wind noise induced by turbulent airflow has several characteristic properties. Firstly, the magnitude of the wind noise can be huge even at relatively low wind speeds. In Dillon, Roe and Katsch "Wind noise in hearing aids: mechanisms and measurements", Report National Acoustic Laboratories, Australia, 1999 it was shown that at a wind speed of 5 m/s all the hearing aid microphones under test became saturated by the wind noise. Secondly, it was shown that the wind noise induced at microphones spaced with a distance in the range between one and two centimeters will exhibit a low correlation.

Typically the distance between the two microphones in a hearing aid is much smaller than the distance between the sound sources and the microphones, and a far field model for the acoustic sounds is therefore appropriate. A typical distance between microphones in a hearing aid is around 10 mm and the acoustical bandwidth of interest in a hearing aid is around 16 kHz or less. Therefore an acoustic sound picked up by two hearing aid microphones will be highly correlated. As opposed hereto wind noise picked up by two hearing aid microphones will exhibit a very low correlation, because the impact of a turbulent airflow to the microphones generally is a near field process.

Figure 1:
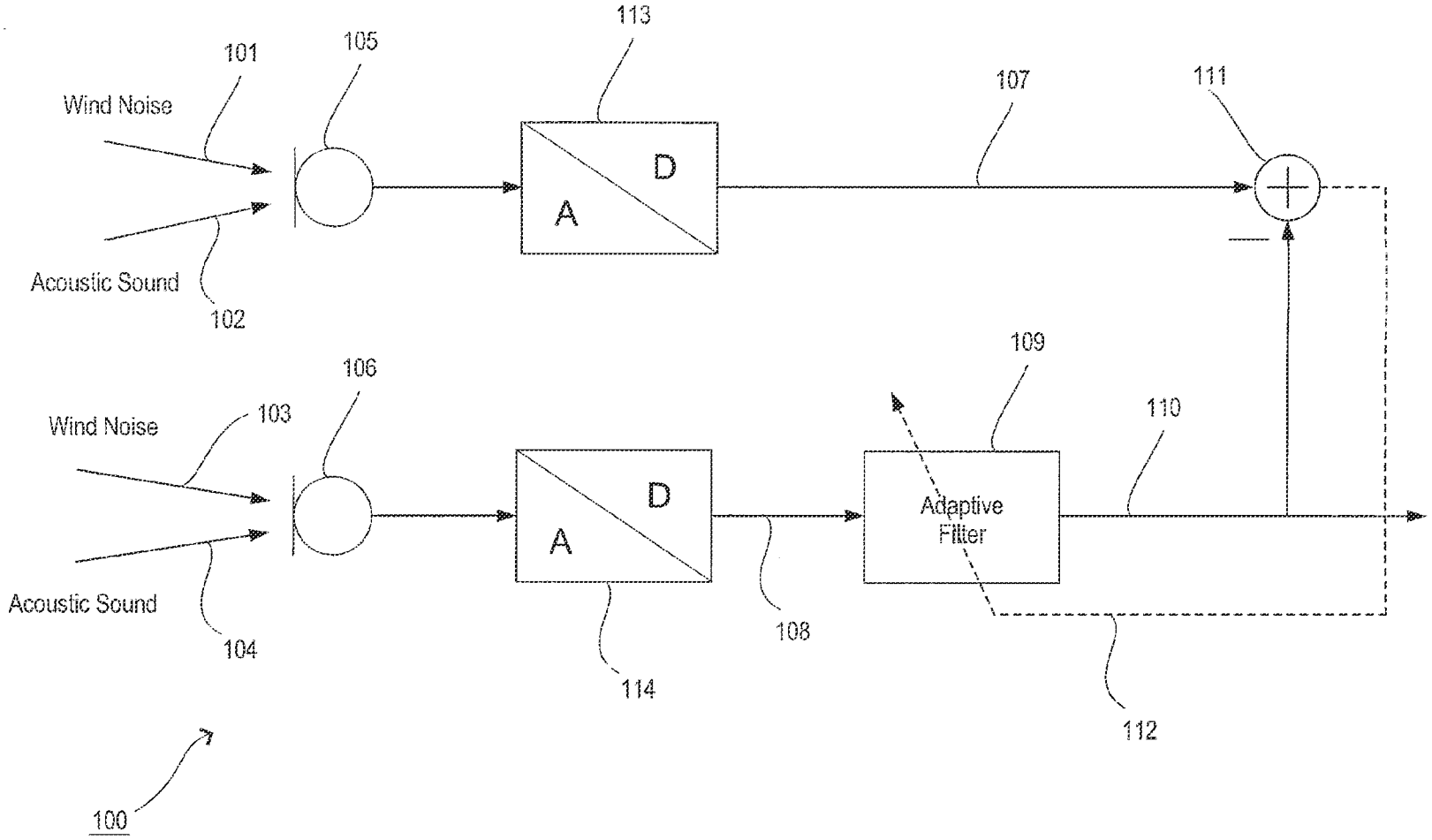
FIG. 1 illustrates highly schematically a processing unit adapted for adaptive wind noise suppression in a hearing aid system according to a first embodiment of the invention.

Reference is first made to FIG. 1, which illustrates highly schematically a processing unit 100 adapted for adaptive wind noise suppression in a hearing aid system according to a first embodiment of the invention. It is assumed that wind noise 101 and 103 and acoustic sound 102 and 104 are picked up by a first microphone 105 and a second microphone 106. The analog signal from the first microphone is converted to a first digital signal 107 in a first analog to digital converter (A/D converter) 113 and the analog signal from the second microphone is converted to a second digital signal 108 in a second A/D converter 114. The output of the first A/D converter is operationally connected to a first input of a subtraction node 111. The output of the second A/D converter is operationally connected to the input of an adaptive filter 109. The output of the adaptive filter 109 is branched and in a first branch operationally connected to the second input of the subtraction node 111 and in a second branch operationally connected to the input of the remaining signal processing in the hearing aid (not shown in the figure). The output of the adaptive filter 109 is denoted third digital signal 110. The output of the subtraction node 111 is denoted fourth digital signal 112, the value of which is calculated as the value of the third digital signal 110 subtracted from the value of the first digital signal 107. The output from the subtraction node 111 is operationally connected to a control input of the adaptive filter 109.

In one embodiment the A/D converter is a sigma-delta converter.

The adaptive wind noise suppression processing unit of FIG. 1 is best understood by considering linear prediction theory. The adaptive filter 109 functions as a linear predictor that takes a number of delayed samples of the second digital signal 108 as input and tries to find the linear combination of these samples that best "predicts" the latest sample of the first digital signal 107. Hereby, ideally, only the correlated part of the first digital signal 107 and the second digital signal 108 is output from the adaptive filter 109. The wind noise parts of the first 107 and second 108 digital signals are basically unpredictable and will therefore, ideally, be left out of the third digital signal 110, which is output from the adaptive filter 109.

The adaptive filter 109 is further described in the following where $y_1(n)$ and $y_2(n)$ denote the first 107 and second 108 digital signal at time n. H(n) is the coefficients vector of the adaptive filter and $Y_2(n)$ is the signal vector of the first digital signal. The prediction error u(n) of the adaptive filter is represented by the fourth digital signal 112 and may be given by the expression (1):

$$u(n)=y_1(n)-H(n)^T Y_2(n) \tag{1}$$

In order to minimize the prediction error, the cost function J can be found as the mean squared error:

$$J=E[u(n)^2]J=E\lfloor(y_1(n)-H(n)^T Y_2(n))^2\rfloor \tag{2}$$

If the signals are stationary, one can find the Wiener solution by taking the gradient of the cost function and setting it to zero:

$$\nabla J=-2R_{y1y2}+2R_{y2y2}H(n)=0 \tag{3}$$

thus:

$$H(n)=\frac{R_{y1y2}}{R_{y2y2}} \tag{4}$$

where $R_{y1y2}$ is the crosscorrelation vector and $R_{y2y2}$ is the autocorrelation matrix. Further details concerning linear prediction may be found e.g. in the book by Simon Haykin "Adaptive filter theory", Prentice Hall, (2001) or in the book by Saeed V. Vaseghi "Advanced digital signal processing and noise reduction", John Wiley & Sons, (2000).

It is known in the art to use a Wiener filter for wind noise suppression, but it is a significant disadvantage of the known methods that estimation of either the noise spectrum or the desired acoustic signal spectrum is required for calculation of the Wiener filter coefficients. According to the present invention only the microphone output signals are required.

In general both speech and wind noise are fluctuating and consequently the filter 109 needs to be able to adapt to these fluctuations. In one embodiment the filter 109 is adapted in accordance with the classical Least Mean Square (LMS) algorithm:

$$H(n+1)=H(n)+\mu\nabla J$$

$$H(n+1)=H(n)+\mu(2Y_2(n)y_1(n)-2Y_2(n)Y_2(n)^T H(n))$$

$$H(n+1)=H(n)+2\mu Y_2(n)(y_1(n)-Y_2(n)^T H(n))$$

$$H(n+1)=H(n)+2\mu Y_2(n)u(n) \tag{5}$$

where μ represents the step size of the adaptation.

In one embodiment the step size of the adaptation is adaptive and proportional to the magnitude of the fourth digital signal 112, which represents the prediction error.

Implementing the classical LMS algorithm or the normalized version of the LMS algorithm (the NLMS algorithm) requires a digital circuitry of a relatively high complexity, which is expensive with respect to power consumption and manufacturing cost.

Figure 5:
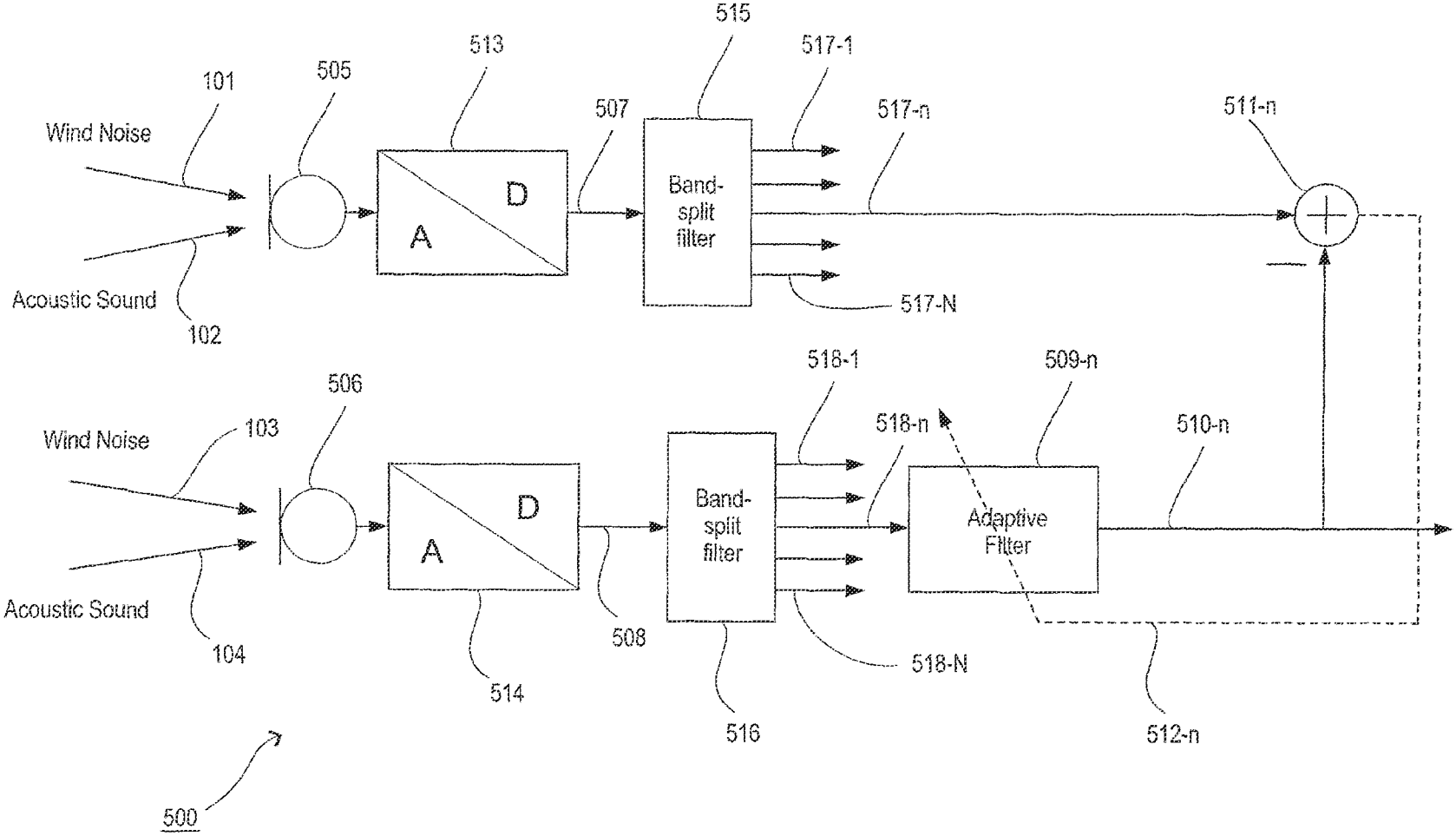
FIG. 5 illustrates highly schematically a processing unit adapted for adaptive wind noise suppression in a hearing aid system according to a fifth embodiment of the invention.

To reduce complexity, according to another embodiment, the NLMS algorithm can be implemented in sub-band form. Reference is now made to FIG. 5, which highly schematically illustrates a processing unit 500 adapted for adaptive wind noise suppression in a hearing aid according to a fifth embodiment of the invention. The processing unit 500 constitutes a sub-band implementation of the adaptive wind noise suppression processing unit. It is assumed that wind noise 101 and 103 and acoustic sound 102 and 104 are picked up by a first microphone 505 and a second microphone 506. The analog signal from the first microphone is converted to a first digital signal 507 in a first analog to digital converter 513 and the analog signal from the second microphone 506 is converted to a second digital signal 508 in a second analog to digital converter 514. The first digital signal 507 and the second digital signal 508 are input to a first band split filter 515 and a second band split filter 516 respectively, hereby providing a number N of frequency sub-bands each having a first digital sub-band signal 517-1, . . . , **517-*n*, . . . , 517-N and a second digital sub-band signal 518-1, . . . , 518-*n*, . . . , 518-N. Only one exemplified, arbitrary frequency band is shown in FIG. 5, the remaining frequency bands being suggested for clarity. Typically this will result in such narrow sub-band frequency bandwidths that the signals in each sub-band may be considered spectrally white, whereby pre-processing of the first digital signal 507 and the second digital signal 508 will not be required. Each sub-band will further comprise a sub-band adaptive filter 509-1, . . . , 509-*n*, . . . , 509-N and a sub-band subtraction node 511-1, . . . , 511-*n*, . . . , 511-N. Each adaptive sub-band filter can have significantly fewer coefficients than the corresponding broad band adaptive filter. In one embodiment one coefficient is sufficient for each sub-band adaptive filter. The output 510-1, . . . 510-*n*, . . . , 510**-N from each of the sub-band adaptive filters are operationally connected to the input of the remaining signal processing in the hearing aid, which includes a sub-band summation block, that is common to all the sub-bands (not shown in the figure).

In an alternative embodiment the sign-sign LMS algorithm can be implemented instead of the NLMS algorithm.

In another embodiment the adaptive filter is a non-linear filter and in yet another embodiment the adaptive filter is non-recursive.

An overview of adaptive filtering may be found in either the book by Simon Haykin "Adaptive filter theory", Prentice Hall, (2001) or in the textbook of Philipp A. Regalia: "Adaptive IIR Filtering in Signal Processing and Control", published in 1995.

In a further embodiment the magnitude of the adaptation step size depends on the sign of the prediction error and the second digital signal. Hereby the wind noise suppression can react fast at the onset of wind noise and slower when the wind noise vanishes. This increases listening comfort and may especially be advantageous in the low frequency bands.

In yet a further embodiment the step size of the adaptation is fixed for the low frequency bands where wind noise dominates speech. Hereby the complexity of the adaptive wind noise suppression processing unit can be reduced.

According to an embodiment the first and second band split filters, used for implementing the sub-band wind noise suppression processing unit, are already part of the standard signal processing in the hearing aid and consequently no additional band split filters are required for implementing the sub-band version of the adaptive wind noise suppression processing unit.

According to another embodiment the sub-band adaptive wind noise suppression processing unit is only applied in the lowest frequency bands because the wind noise in the high frequency bands is negligible. Hereby system complexity and power consumption may be reduced.

According to yet another embodiment the adaptive wind noise suppression processing unit is only activated in response to a detection of wind noise. In one embodiment the cross-correlation of the first and second digital signal is calculated and compared with a first threshold value. A detection of wind noise is assumed if the cross-correlation is below the first threshold value. In a specifically advantageous embodiment the calculated cross-correlation value is also used by other parts of the hearing aid. In this embodiment the wind noise detection may be performed at short time intervals while only requiring limited additional power consumption.

In a further embodiment detection of wind noise is also dependent on whether an estimate of the power level in the first and second digital signals is above a second threshold value.

In another embodiment the adaptive wind noise suppression processing unit is also used for suppressing other types of uncorrelated noise. One example of uncorrelated noise is internal microphone noise. This type of noise is typically only audible when the signal power level is very low. Therefore the wind noise suppression processing unit is activated in the situation when the cross-correlation of the first and second digital signal is below a third threshold value and the estimate of the power level in the first and the second digital signal respectively is below a fourth threshold value.

In another embodiment the adaptive wind noise suppression processing unit is only activated in response to a detection of an incident of wind noise. When activated the adaptive wind noise suppression processing unit is not de-activated until a time period has elapsed without a new detection of an incident of wind noise. In one embodiment the time period is larger than 10 seconds. In another embodiment the time period is smaller than two minutes. Preferably the time period is around 20 seconds. Hereby a smooth adaptive wind noise suppression with few abrupt changes may be realized because too frequent activation and de-activation of the adaptive wind noise suppression processing unit can be avoided. Still the adaptive wind noise suppression processing unit is de-activated when no wind noise is detected in a given time period in order to reduce power consumption.

Figure 2:
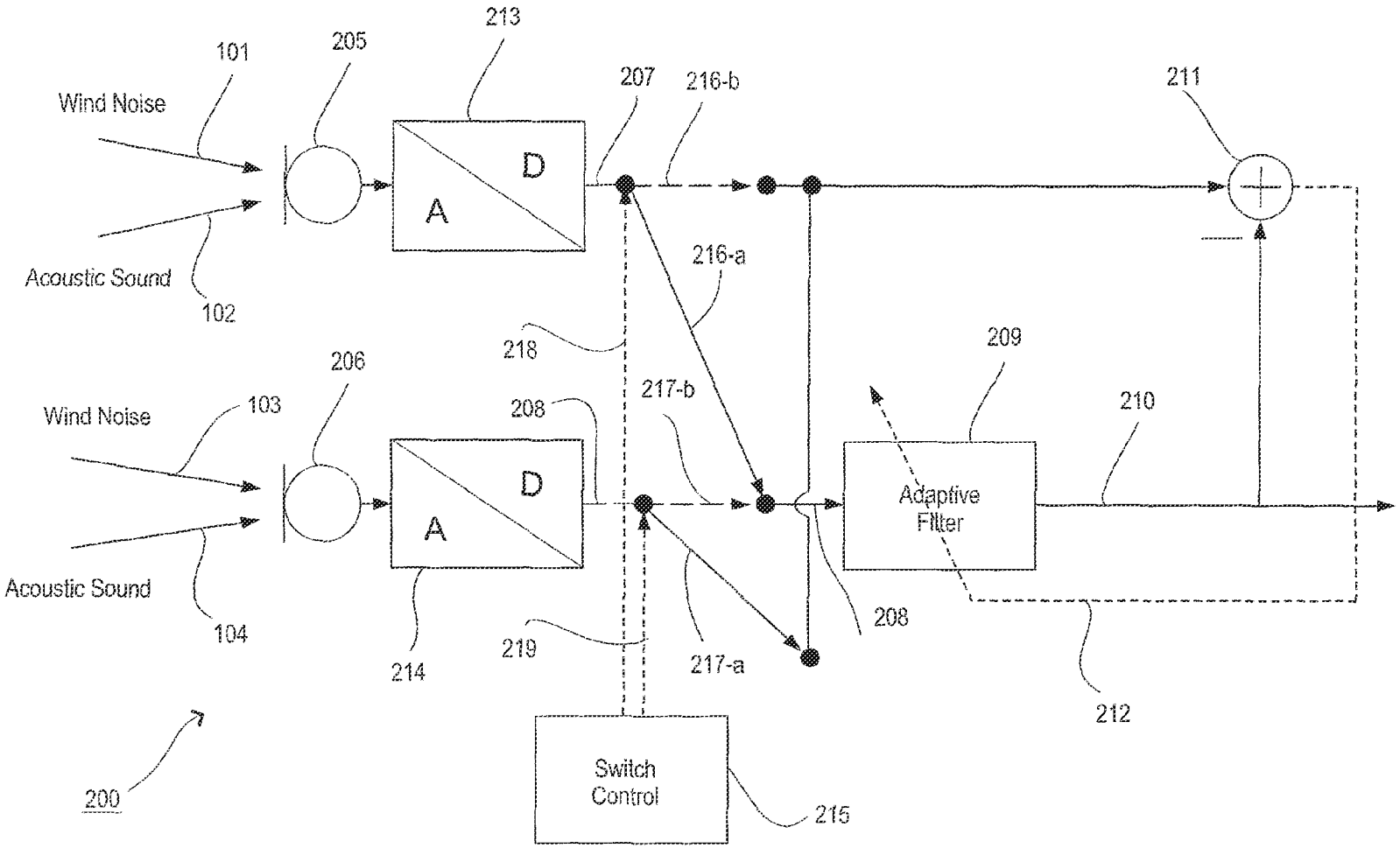
FIG. 2 illustrates highly schematically a processing unit adapted for adaptive wind noise suppression in a hearing aid system according to a second embodiment of the invention.

Reference is now made to FIG. 2, which illustrates highly schematically a processing unit 200 adapted for adaptive wind noise suppression in a hearing aid system according to a second embodiment of the invention. FIG. 2 is similar to FIG. 1 in that, it is assumed that wind noise 101 and 103 and acoustic sound 102 and 104 is picked up by a first microphone 205 and a second microphone 206. The analog signal from the first microphone is converted to a first digital signal 207 in a first A/D converter 213 and the analog signal from the second microphone is converted to a second digital signal 208 in a second A/D converter 214. Whichever of the first 207 or the second digital signal 208 has the lowest level of wind noise will be operationally connected to the input of the adaptive filter 209, and the first 207 or the second digital signal 208 having the highest level of wind noise will be operationally connected to the first input of the subtraction node 211. A first switch allows the output from the first A/D converter 213 to be operationally connected to the input of the adaptive filter 209, represented in FIG. 2 by the arrow 216-*a*, or to the first input of the subtraction node 211, represented in FIG. 2 by the arrow 216-*b*. A second switch allows the output from the second A/D converter 214 to be operationally connected to the input of the adaptive filter 209, represented in FIG. 2 by the arrow 217-*b*, or to the first input of the subtraction node 211, represented in FIG. 2 by the arrow 217-*a*. The switches are set by unit 215 using control signals 218 and 219. The switches will take positions 216-*b* and 217-*b* when the wind noise level in the first digital signal 207 is higher than the wind noise level in the second digital signal 208. Alternatively the switching system will take positions 216-*a* and 217-*a*.

In one embodiment the switch control unit 215 estimates and compares the power level of the two digital signals 207 and 208 in order to determine the level of wind noise. The estimated power levels may be calculated as an absolute average value, a percentile value or some other kind of signal level estimate.

The remaining part of the adaptive wind noise suppression processing unit is similar to FIG. 1 in that the output of the adaptive filter 209 is branched and in a first branch operationally connected to the second input of the subtraction node 211 and in a second branch operationally connected to the input of the remaining signal processing in the hearing aid (not shown in the figure). The output of the adaptive filter 209 is denoted the third digital signal 210. The output of the subtraction node 211 is operationally connected to the control input of the adaptive filter 209. The fourth digital signal 212, which is output from the subtraction node 211, is calculated as the value of the third digital signal 210 subtracted from the value of the first digital signal 207.

The wind noise suppression processing unit according to the embodiment illustrated in FIG. 2 is advantageous with respect to wind noise suppression efficiency.

Many contemporary hearing aids include a fixed directional system or even an adaptive directional system. Such systems typically include means for spatially transforming the first and the second digital microphone output signals. Examples of spatial transformations include adding the two digital signals hereby creating an omni-directional signal or subtracting the two digital signals hereby creating a bi-directional signal. According to one embodiment of the present invention, the wind noise suppression processing unit uses as input the first and second digital microphone output signals before spatial transformation and provides as output only a single digital signal wherein the wind noise has been suppressed. Therefore, according to an embodiment of the invention, the wind noise suppression processing unit has means adapted for triggering by-passing of spatially transforming means in response to a detection of wind noise.

Figure 3:
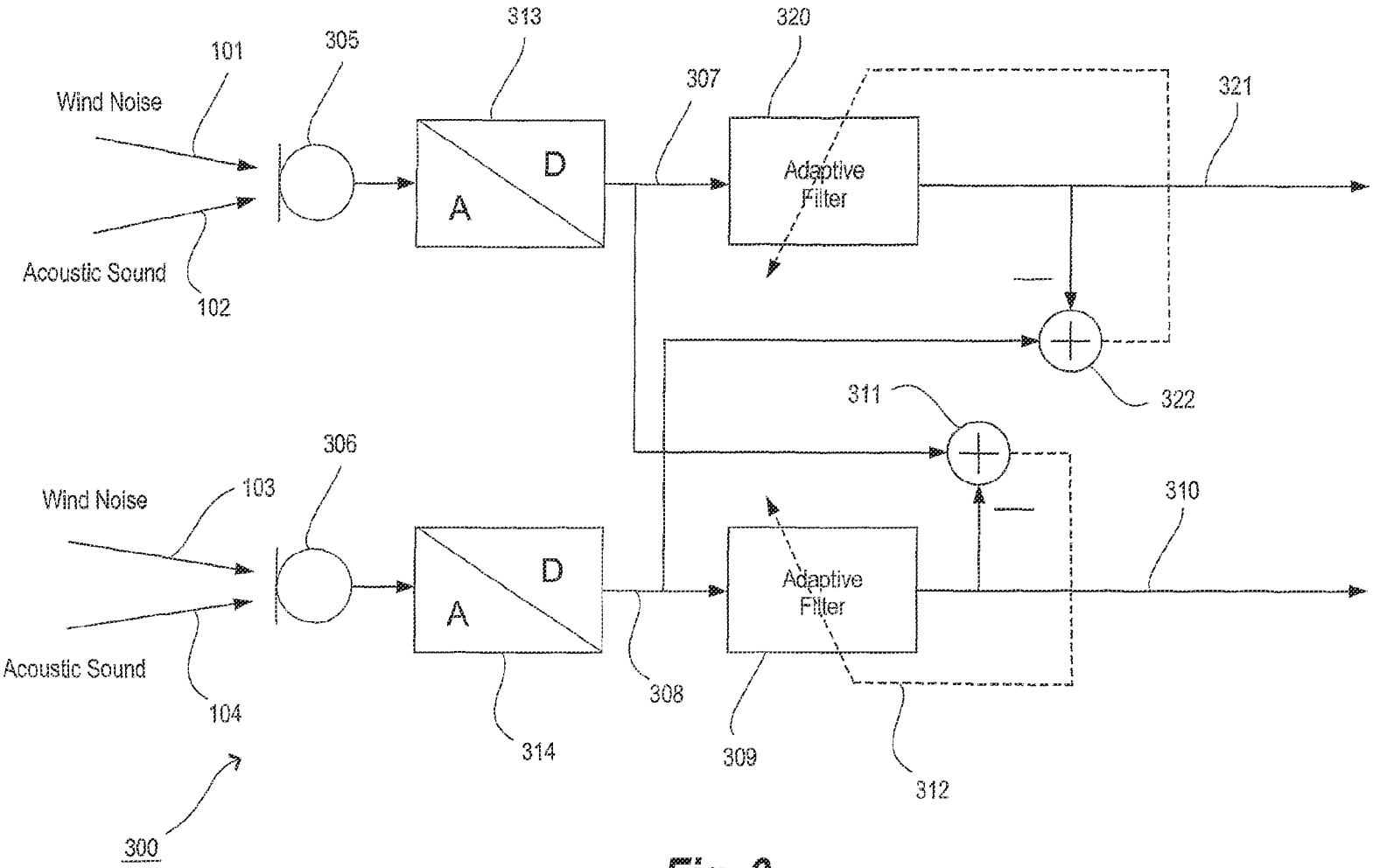
FIG. 3 illustrates highly schematically a processing unit adapted for adaptive wind noise suppression in a hearing aid system according to a third embodiment of the invention.

Reference is now made to FIG. 3, which illustrates highly schematically the part of a hearing aid 300, which comprises a wind noise suppression processing unit according to a third embodiment of the invention, that outputs two digital signals, wherein the wind noise has been suppressed and the phase information between the two digital signals is preserved. FIG. 3 is similar to FIG. 1 in that, it is assumed that wind noise 101 and 103 and acoustic sound 102 and 104 is picked up by a first microphone 305 and a second microphone 306. The analog signal from the first microphone is converted to a first digital signal 307 in a first A/D converter 313, and the analog signal from the second microphone is converted to a second digital signal 308 in a second A/D converter 314. The output of the first A/D converter 313 is branched and in a first branch operationally connected to the input of a second adaptive filter 320, and in a second branch operationally connected to a first input of a first subtraction node 311. In a similar manner the output of the second A/D converter 314 is branched and in a first branch operationally connected to the input of a first adaptive filter 309, and in a second branch operationally connected to a first input of a second subtraction node 322. The output of the second adaptive filter 320 is branched and in a first branch operationally connected to the second input of the second subtraction node 322, and in a second branch operationally connected to the input of the remaining signal processing in the hearing aid (not shown in the figure). In a similar manner the output of the first adaptive filter 309 is branched and in a first branch operationally connected to the second input of the first subtraction node 311, and in a second branch operationally connected to the input of the remaining signal processing in the hearing aid (not shown in the figure). The output of the first subtraction node 311 is operationally connected to the control input of the first adaptive filter 309, and the output of the second subtraction node 322 is operationally connected to the control input of the second adaptive filter 320.

This provides a wind noise suppression processing unit that may be implemented together with a directional system, in a simple and efficient manner.

In another embodiment the wind noise suppression processing unit is only implemented in low frequency sub-bands while the beam forming is implemented in the remaining higher frequency sub-bands.

Many contemporary hearing aids also include an adaptive feedback suppression processing unit in addition to the directional system. In one implementation of such a hearing aid the value of a first feedback suppressing signal is subtracted from the value of a digital signal exhibiting an omni-directional characteristic, and the value of a second feedback suppressing signal is subtracted from the value of a digital signal exhibiting a bi-directional characteristic. Such a hearing aid is further described in WO-A1-2007042025.

According to one embodiment of the present invention a detection of wind noise triggers de-activation of the spatially transforming means, and consequently the value of the first feedback suppressing signal will be subtracted from the value of the first digital microphone output signal instead of from the value of the digital signal exhibiting an omni-directional characteristic, and the value of the second feedback suppressing signal will be subtracted from the value of the second digital microphone output signal instead of from the value of the digital signal exhibiting a bi-directional characteristic.

In another preferred embodiment the combination of the feedback suppressing signal with the digital signal exhibiting a bi-directional characteristic will be de-activated in response to a detection of wind noise. Hereby, sound artifacts and less efficient wind noise suppression, due to the adaptive modeling of the feedback in the bi-directional signal branch, is avoided.

Figure 4:
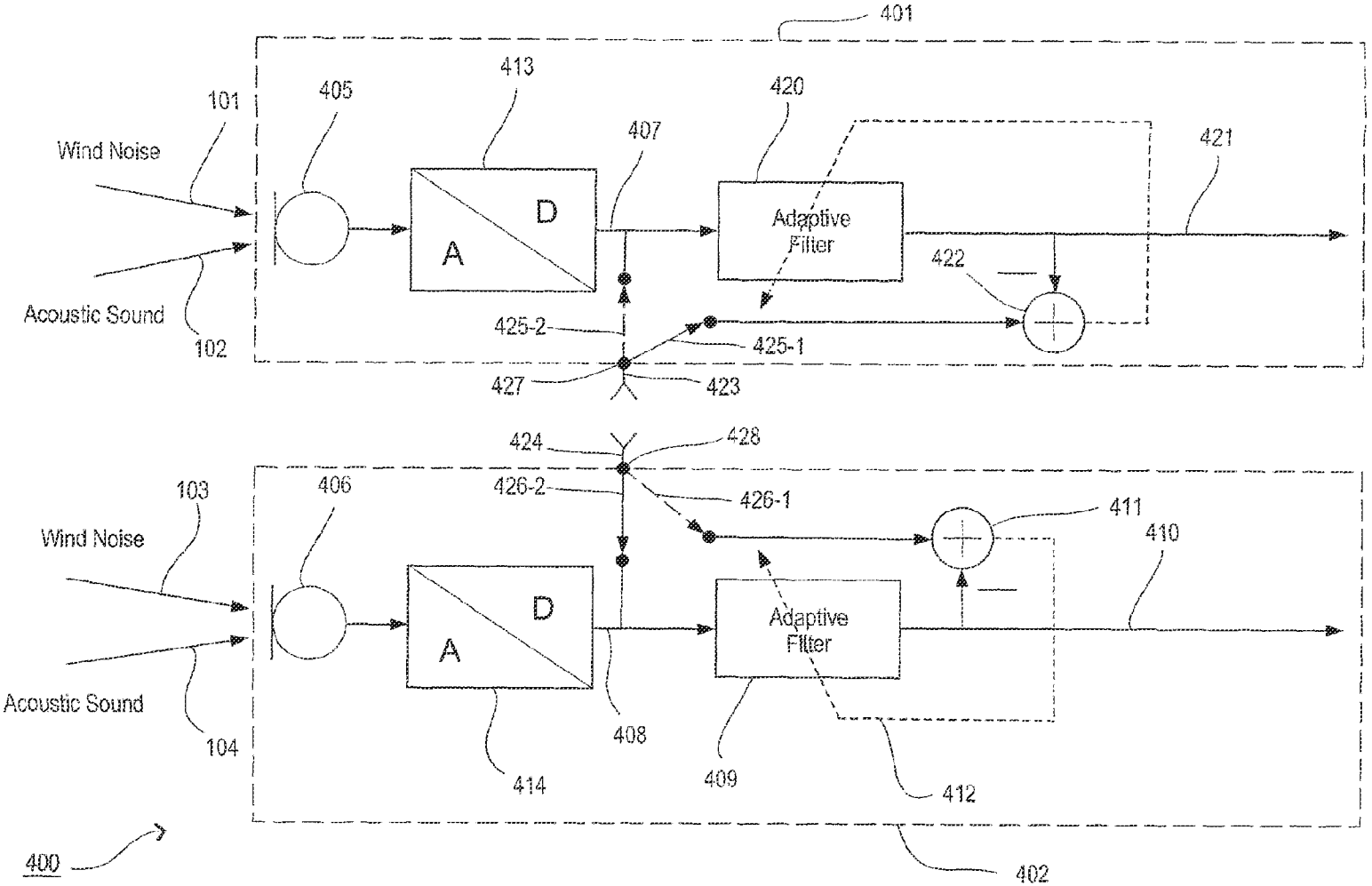
FIG. 4 illustrates highly schematically part of a binaural hearing aid system having a processing unit adapted for adaptive wind noise suppression according to a fourth embodiment of the invention.

Reference is now made to FIG. 4, which illustrates highly schematically part of a binaural hearing aid system 400 according to a fourth embodiment of the invention, which consists of a first hearing aid 401 and a second hearing aid 402 (for clarity only a first part of the hearing aids is shown). Each of the hearing aids comprises an input microphone 405, 406, an A/D converter 413, 414, an adaptive filter 409, 420, a subtraction node 411, 422, an antenna 423, 424 connected to appropriate transceiving means (not shown) for providing a bi-directional link between the two hearing aids, and a switch 427 and 428. The hearing aid switches allow the binaural hearing aid system to be configured in two ways. In a first situation the output from the A/D converter 413 in the first hearing aid is operationally connected to the first input of the subtraction node 411 in the second hearing aid, by setting the first switch 427 to the position represented by arrow 425-2 and the second switch 428 to the position represented by arrow 426-1. In the second situation the output from the A/D converter 414 in the second hearing aid is operationally connected to the first input of the subtraction node 422 in the first hearing aid by setting the first switch 427 to the position represented by arrow 425-1 and the second switch 428 to the position represented by arrow 426-2. In a preferred embodiment the hearing aid system cycles between the two switch configurations in order to provide continuous updating of the adaptive filters.

This provides a binaural hearing aid system with improved adaptive suppression of wind noise induced by low frequency turbulence, because this type of wind noise maintains correlation over a longer distance than wind noise induced by high frequency turbulence. Additionally this type of noise suppression will also be effective against noise that originates from a position very close to one of the intended hearing aid users ears. An example is noise resulting from positioning the hearing aid or operating a control on the hearing aid. Further the binaural hearing aid system according to this embodiment may be implemented even when each of the hearing aids only contains one microphone.

Figure 6:
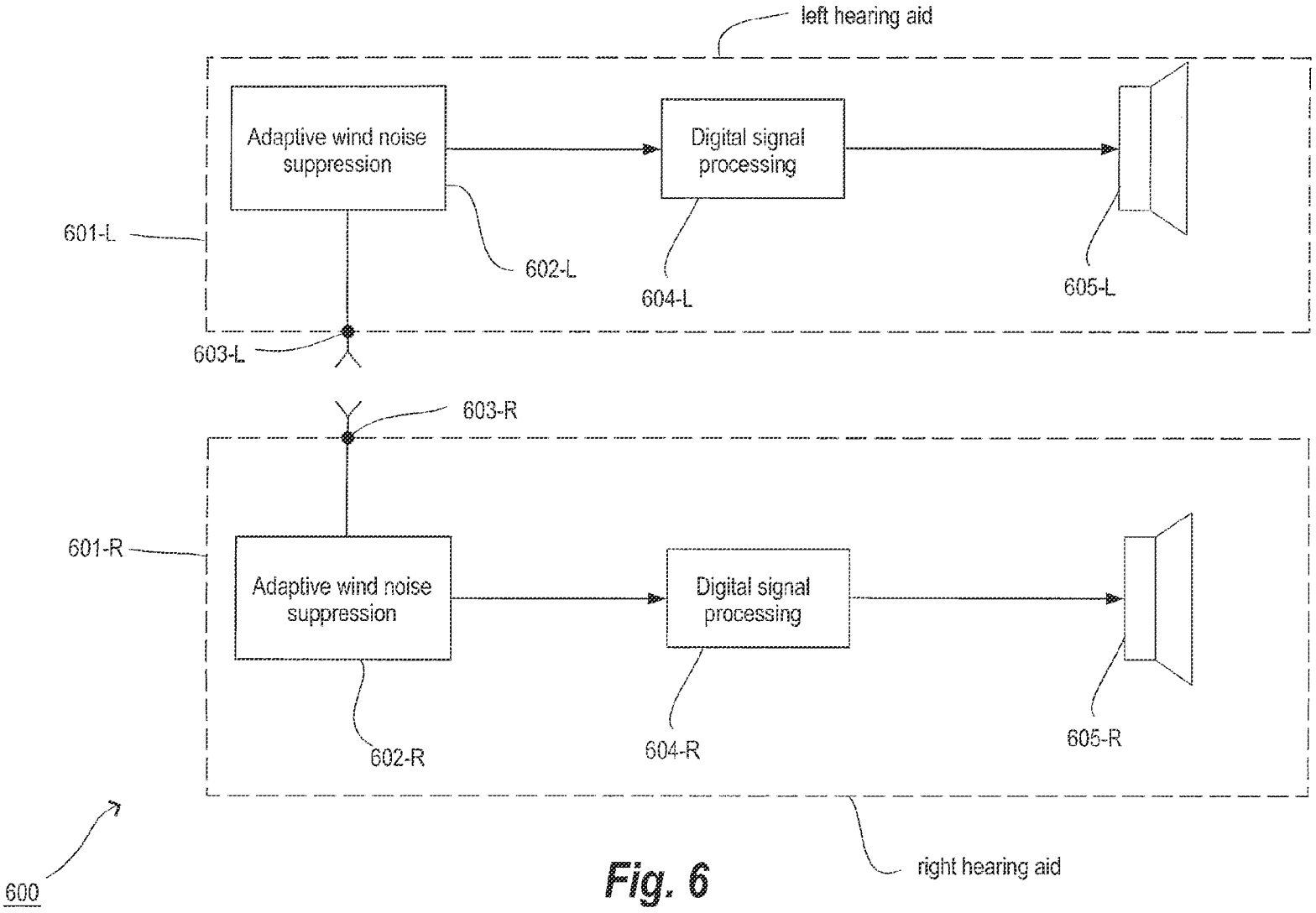
FIG. 6 illustrates highly schematically a binaural hearing aid system according to a sixth embodiment of the invention.

Reference is now made to FIG. 6, which illustrates highly schematically a binaural hearing aid system 600 according to a sixth embodiment of the invention. The binaural hearing aid system 600 comprises a left hearing aid 601-L and a right hearing aid 601-R. Each of the hearing aids comprises an adaptive wind noise suppression processing unit 602-L and 602-R, an antenna 603-L and 603-R for providing a bi-directional link between the two hearing aids, a digital signal processing unit 604-L and 604-R and an acoustic output transducer 605-L and 605-R.

Other modifications and variations of the structures and procedures will be evident to those skilled in the art.

We claim:

1. A processing unit for adaptive wind noise suppression in a hearing aid system comprising a first and a second microphone for conversion of an acoustic signal into a first and a second electric signal, respectively, a first and a second A/D converter for conversion of the first and the second electric signal into a first and a second digital signal, respectively, a first subtraction node, and a first adaptive filter, the first subtraction node having a first input, which is operationally connected to the output of the first A/D converter, a second input which is operationally connected to the output of the first adaptive filter, and an output denoted a fourth digital signal which is fed to a control input to the first adaptive filter, the first adaptive filter having an input, which is operationally connected to an output of the second A/D converter, an output denoted a third digital signal, which represents a wind noise suppressed signal and is fed to an input of a digital signal processor and to the second input of the first subtraction node, and a control input for controlling the adaptation of the first adaptive filter, the value of the fourth digital signal being calculated as the value of the third digital signal subtracted from the value of the first digital signal.

2. The processing unit according to claim 1, comprising a switching component configured to selectively connect the output of said first A/D converter to the input of the first adaptive filter or to the input of the first subtraction node and to selectively connect the output of said second A/D converter to the other one of said two inputs.

3. The processing unit according to claim 2, comprising a power estimator for estimating the power levels in the first and second digital signal, a comparison component for comparing the two estimated power levels, and a controller for controlling the switching component based on the result of the comparison between the two estimated power levels, such that the A/D converter outputting the digital signal with the lowest power level will be connected to the input of the adaptive filter, while the A/D converter outputting the digital signal with the highest power level will be connected to the input of the subtraction node.

4. The processing unit according to claim 1, comprising a second subtraction node, and a second adaptive filter, the second subtraction node having a first input which is connected to the output of the second A/D converter, a second input which is connected to the output of the second adaptive filter and an output which is connected to a control input to the second adaptive filter, and the second adaptive filter having an input which is connected to the output of the first A/D converter, an output which is connected to an input of the digital signal processor and to a second input of the second subtraction node, and a control input for controlling the adaptation of the second adaptive filter.

5. The processing unit according to claim 1, comprising a wind noise detector for detection of an incident of wind noise.

6. The processing unit according to claim 5, wherein said wind noise detector is configured to calculate the value of the cross-correlation between said first and said second digital signal and to compare said cross-correlation value with a first threshold value.

7. The processing unit according to claim 6, wherein said wind noise detector is further configured to estimate the power level in the first and second digital signals and to compare these power levels with a second threshold value.

8. The processing unit according to claim 5, comprising a control component configured to activate at least the first adaptive filter and the first subtraction node for a predetermined time period in response to a detection of an incident of wind noise.

9. The processing unit according to claim 8 wherein said predetermined time period is in the range between 10 seconds and 2 minutes.

10. The processing unit according to claim 8, wherein the first adaptive filter and the first subtraction node are deactivated when a time span, corresponding to said predetermined time period, has elapsed without a new detection of an incident of wind noise.

11. The processing unit according to claim 1, comprising a spatial transformer of a directional system and a triggering component configured to trigger by-passing of the spatial transformer in response to a detection of an incident of wind noise.

12. The processing unit according to claim 1, comprising a band splitting component configured to perform frequency band splitting hereby providing a set of frequency sub-bands, each having a first and a second digital sub-band signal, a sub-band adaptive filter and a sub-band subtraction node.

13. The processing unit according to claim 12, wherein each of said sub-band adaptive filters contains one coefficient.

14. The processing unit according to claim 12, comprising an updating component configured to update said sub-band adaptive filter in accordance with an NLMS algorithm.

15. The processing unit according to claim 12, comprising an updating component configured to update said sub-band adaptive filter in accordance with a sign-sign LMS algorithm.

16. The processing unit according to claim 12, wherein a fraction of the frequency sub-bands provided by said band splitting component comprises a first and a second digital sub-band signal, a sub-band adaptive filter and a sub-band subtraction node.

17. The processing unit according to claim 11, comprising a combiner configured to selectively combine a first feedback compensation signal with a first digital signal or with a first spatially beam transformed digital signal, and to selectively combine a second feedback compensation signal with the second digital signal or with a second spatially beam transformed digital signal, and a deactivation component configured to activate the combination of the first feedback compensation signal with the first digital signal in response to a detection of an incident of wind noise.

18. The processing unit according to claim 17, wherein the first spatially beam transformed digital signal exhibits a bi-directional characteristic.

19. The processing unit according to claim 1, comprising a noise detector configured to detect the presence of internal microphone noise and an activation component configured to activate at least the first adaptive filter and the first subtraction node in response to such detection.

20. A hearing aid comprising a processing unit according to claim 1.

21. A binaural hearing aid system having a first and a second hearing aid wherein said first hearing aid comprises a first microphone, a first A/D converter, a first adaptive filter, a first subtraction node, a first digital signal processor, a first switch, a first antenna and first transceiver, said second hearing aid comprises a second microphone, a second A/D converter, a second adaptive filter, a second subtraction node, a second digital signal processor, a second switch, a second antenna and second transceiver, the first and second transceivers and the first and second antenna are configured to provide a bi-directional link between the first and the second hearing aid, the first subtraction node has a first input, which is connected to the output of the second A/D converter, a second input, which is connected to the output of the first adaptive filter and an output, which is connected to a control input to the first adaptive filter, the first adaptive filter has an input, which is connected to the output of the first A/D converter, an output, which represents a wind noise suppressed signal and is connected to an input of the first digital signal processor and to a second input of the first subtraction node, and a control input for controlling the adaptation of the first adaptive filter the second subtraction node has a first input, which is connected to the output of the first A/D converter, a second input, which is connected to the output of the second adaptive filter and an output, which is connected to a control input to the second adaptive filter, and the second adaptive filter has an input, which is connected to the output of the second A/D converter, an output, which is connected to an input of the second digital signal processor and to a second input of the second subtraction node, and a control input for controlling the adaptation of the second adaptive filter.

22. A method of adaptive wind noise suppression in a hearing aid comprising the following steps:

providing a first signal representing the output from a first microphone, providing a second signal representing the output from a second microphone, filtering the first signal in an adaptive filter, thereby providing a third signal, subtracting the value of the third signal from the value of the second signal in a subtraction node, thereby providing a fourth signal, feeding the value of the fourth signal to a control input of the adaptive filter, and providing the third signal as a wind noise suppressed signal for further processing in the hearing aid.

23. A processing unit according to claim 1, wherein said hearing aid system includes said first and second microphones, an acoustic output transducer, and said digital signal processor signal processor which processes its input signal to produce therefrom a compensated signal for reproduction by said hearing aid acoustic output transducer.

24. A binaural hearing aid system according to claim 21, wherein said first digital signal processor processes its input signal to produce therefrom a first compensated signal for reproduction by a first acoustic output transducer, and said second digital signal processor processes its input signal to produce therefrom a second compensated signal for reproduction by a second acoustic output transducer.

25. A method according to claim 22, wherein said further processing in said hearing aid comprises processing said third signal to produce therefrom a compensated signal for reproduction by an acoustic output transducer of said hearing aid.

* * * * *